US006967433B2

(12) United States Patent
Hsu

(10) Patent No.: US 6,967,433 B2
(45) Date of Patent: Nov. 22, 2005

(54) COLD CATHODE FLUORESCENT FLAT LAMP

(75) Inventor: Horng-Bin Hsu, Taipei (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 10/695,261

(22) Filed: Oct. 27, 2003

(65) Prior Publication Data

US 2005/0035712 A1 Feb. 17, 2005

(30) Foreign Application Priority Data

Aug. 12, 2003 (TW) ..... 92122063 A

(51) Int. Cl.[7] ..... H01J 63/04
(52) U.S. Cl. ..... 313/491; 313/493; 313/582
(58) Field of Search ..... 313/491–495, 313/483–485, 238–240, 609, 610, 631, 582–587, 292, 268; 445/24, 25; 315/169.1, 169.2, 169.3, 169.4, 167

(56) References Cited

U.S. PATENT DOCUMENTS 5,990,617 A * 11/1999 Kanae et al. ..... 313/582
6,479,933 B1 * 11/2002 Chen ..... 313/582
6,747,409 B1 * 6/2004 Han et al. ..... 313/582
6,787,981 B2 * 9/2004 Yoo et al. ..... 313/491
6,800,010 B1 * 10/2004 Hibino et al. ..... 313/582
6,821,178 B2 * 11/2004 Sugimoto et al. ..... 445/24

* cited by examiner

*Primary Examiner*—Wilson Lee
(74) *Attorney, Agent, or Firm*—J.C. Patents

(57) ABSTRACT

A cold cathode fluorescent lamp is provided. The cold cathode fluorescent lamp includes a first substrate, a plurality of electrode pairs, a second substrate, a plurality of barrier ribs, a fluorescent material and a discharge gas. The second substrate is disposed over the first substrate. The plurality of barrier ribs are disposed between the first substrate and the second substrate to form a plurality of gas discharge space. The fluorescent material is disposed on inner walls of the plurality of gas discharge space. The discharge gas is disposed in the plurality of gas discharge space. By disposing the barrier ribs between two substrates, each electrode pair is separated to prevent cross-talk effect.

14 Claims, 3 Drawing Sheets

COLD CATHODE FLUORESCENT FLAT LAMP

CROSS-REFERENCE TO RELATED APPLICATION

This application claims the priority benefit of Taiwan application serial no. 92122063, filed on Aug. 12, 2003.

BACKGROUND OF THE INVENTION

1. Field of the Invention

This invention generally relates to a cold cathode fluorescent flat lamp, and more particularly to a cold cathode fluorescent flat lamp for separating each group of plasma produced by each electrode pair to prevent cross-talk state.

2. Description of the Related Art

As technology advances, digital devices such as mobile phones, digital cameras, notebook computers, desktop computers are developed to provide multi-functions and easiness to use. For such devices, a display is an indispensable interface for the users to communicate with. Most of such digital devices use LCD panels as their displays in the past years. However, a back light module is required for a LCD panel because the LCD panel itself is not self-emitting.

Since a cold cathode fluorescent flat lamp can provide a good light-emitting efficiency and uniformity, and is a better light source for a larger panel, it had been well applied to the back light modules for LCD panels and other applications. A cold cathode fluorescent flat lamp is a plasma light-emitting device where a high voltage waveform is applied between electrodes to excite the inert gas in the discharge space to high-energy excited molecules, ions, and electrons. Those high-energy excited molecules, ions, and electrons are so-called plasma. The plasma will emit the ultraviolet rays to release the energy and to further excite the fluorescent materials in the cold cathode fluorescent flat lamp, thereby emitting the visible light.

FIG. 1 is a structural view of a conventional cold cathode fluorescent flat lamp. The cold cathode fluorescent flat lamp 100 comprises a first substrate 110, a second substrate 120, a side wall 130, a plurality of electrode pairs 140 (FIG. 1 shows 3 electrode pairs as an example), a fluorescent material 150, and a discharge gas 160. The side wall 130 is disposed at the edge of cold cathode fluorescent flat lamp 100 between the first substrate and the second substrate to form a gas discharge space 170. In addition, a plurality of spacers can be disposed between the substrates to reinforce the structural strength at the central part of the cold cathode fluorescent flat lamp 100.

Referring to FIG. 1, the electrode pair 140 includes an X electrode 140*a* and a Y electrode 140*b*. The X electrode 140*a* and the Y electrode 140*b* are usually strip electrodes that are disposed in parallel on the first substrate 110. A dielectric layer 180 will usually be disposed on the electrode pair 140 to protect the electrode pair 140 from ion impacts. Further, the discharge gas 160 such as Xe, Ne, Ar, or mixture thereof, is injected into the gas discharge space 170. In addition, the fluorescent material is disposed on the inner wall of the gas discharge space 170 such as the surface of the second substrate 120 or the dielectric layer 180.

The process to turn on the cold cathode fluorescent flat lamp 100 is to apply a high voltage waveform between the X electrode and the Y electrode of the electrode pairs to excite the inert gas to a plasma state. Those excited atoms will emit the ultraviolet rays to release the energy and to further excite the fluorescent material 150 on the inner wall of the gas discharge space 170. However, the electrodes of the conventional cold cathode fluorescent flat lamp are placed in the same gas discharge space. That is, the discharge gas could flow through all the electrodes. During the blink mode, some plasma will flow to a non-emitting area and cause interference so that the individual electrode pair cannot be precisely controlled.

SUMMARY OF THE INVENTION

An object of the present invention is to provide a cold cathode fluorescent flat lamp, wherein a plurality of barrier ribs is disposed to separate the plasma generated by the electrode pairs, and also to increase the surface areas of the fluorescent material. Thus, the cross-talk effect during the discharge period can be prevented and the light-emitting efficiency and uniformity can also be enhanced.

In accordance with the above object and other advantages, the present invention provides a cold cathode fluorescent flat lamp. The cold cathode fluorescent flat lamp of the present invention comprises a first substrate, a plurality of electrode pairs, wherein the plurality of electrode pairs being disposed on the first substrate, each of the plurality of electrode pairs includes an X electrode and a cathode; a second substrate disposed above the first substrate; a plurality of barrier ribs disposed between the first substrate and the second substrate forming a plurality of gas discharge spaces between the first substrate and the second substrate, wherein each of the gas discharge spaces comprises an electrode pair; a fluorescent material disposed on inner walls of the plurality of gas discharge space; and discharge gas sealed in the plurality of gas discharge space.

In a preferred embodiment of the present invention, the plurality of barrier ribs is comprised of stripes. The width of the bottom of the barrier ribs is wider than a width of the top of the barrier ribs. The cross section of each of the barrier ribs is comprised of a triangle or a trapezoid. Further, the material of the barrier ribs is comprised of, for example, a dielectric material.

In a preferred embodiment of the present invention, the X electrodes of the plurality of electrode pairs are connected in parallel to provide the same voltage waveform. The Y electrodes of the plurality of electrode pairs are connected in parallel to provide the same voltage waveform. Further, the electrode pairs are disposed in an order of the X electrode and the Y electrode alternately on the first substrate.

In a preferred embodiment of the present invention, a dielectric layer is disposed on the plurality of electrode pairs and a portion of the fluorescent material to protect the electrode pairs from ion impacts.

In a preferred embodiment of the present invention, the discharge gas in the gas discharge space is an inert gas such as one of Xe, Ne, Ar, and a mixture thereof. The electrode pairs are comprised of metal such Ag, Cu, or Cr—Cu—Cr alloy.

In a preferred embodiment of the present invention, a plurality of barrier ribs are disposed between two substrates and each of the electrode pairs is disposed into the gas discharge space, wherein each electrode pair is separated from the other electrode pair by the barrier ribs. Hence, during the on/off operation of the individual electrode pair, the plasma will not flow to a non-emitting area to cause cross-talk effect. Further, the surface areas of the fluorescent material can be increased by coating the fluorescent material on the barrier ribs, thereby enhancing the light-emitting efficiency and uniformity of the cold cathode fluorescent flat lamp.

The above is a brief description of some deficiencies in the prior art and advantages of the present invention. Other features, advantages and embodiments of the invention will be apparent to those skilled in the art from the following description, accompanying drawings and appended claims.

DESCRIPTION OF THE PREFERRED EMBODIMENTS

Figure 1:
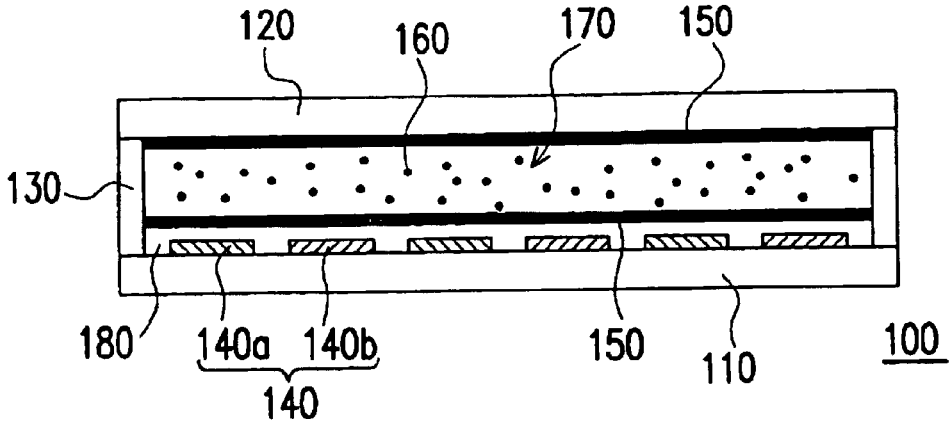
FIG. 1 (PRIOR ART)
FIG. 1 is a structural view of a conventional cold cathode fluorescent flat lamp.
Figure 2:
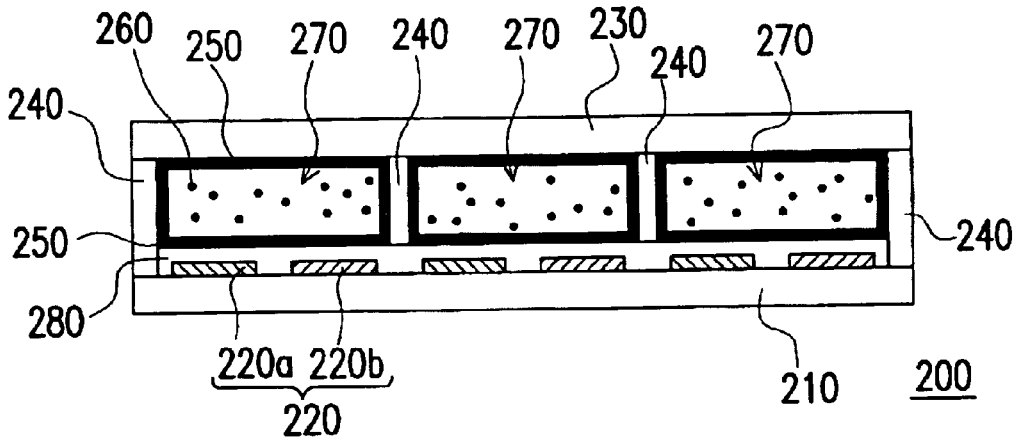
FIG. 2 (PRIOR ART)
FIG. 2 is a structural view of a cold cathode fluorescent flat lamp according to a preferred embodiment of the present invention.

FIG. 2 is a structural view of a cold cathode fluorescent flat lamp according to a preferred embodiment of the present invention. Referring to FIG. 2, the cold cathode fluorescent flat lamp 200 comprises a first substrate 210, a plurality of electrode pairs 220, a second substrate 230, a plurality of barrier ribs 240, a fluorescent material 250, and a discharge gas 260. The plurality of electrode pairs 220 are disposed on the first substrate 210. Each of the plurality of electrode pairs 220 includes an X electrode 220*a* and a Y electrode 220*b*. Those electrodes are comprised of parallel stripes. The electrode material is comprised of a metal, such as Ag, Cu and Cr—Cu—Cr alloy.

Referring to FIG. 2, a second substrate is disposed over the first substrate. The first substrate 210 and the second substrate 230 are comprised of, for example, glass. The plurality of barrier ribs 240 are disposed between the first substrate 210 and the second substrate 230 to form a plurality of gas discharge space 270. Each of the plurality of electrode pairs 220 corresponds to each of the plurality of gas discharge space 270. The fluorescent material 250 is disposed on inner walls of the plurality of gas discharge space 270, such as the surfaces of the first substrate 210 and the second substrate 230. The discharge gas 260 is injected in the plurality of gas discharge space 270. Further, a dielectric layer 280 is disposed on the electrode pairs 220 to protect the electrodes of the electrode pair 220 from ion impacts. In addition, the barrier ribs 240 can be comprised of dielectric materials to protect themselves from ion impacts.

To light up the cold cathode fluorescent flat lamp 200, a high voltage waveform is applied between the X electrode and the Y electrode of the electrode pairs 220 to excite the discharge gas 260 in the gas discharge space 270 to the plasma state which includes excited molecules, ions and electrons. Subsequently, the plasma will emit the ultraviolet rays to release the energy and to further excite the fluorescent material 250 on the inner wall of the gas discharge space 270. It should be noted that each electrode pair is separated by the barrier ribs 240 so that the plasma generated by the individual electrode pair only releases the energy within its own gas discharge space 270 and will not flow to the other gas discharge spaces 270. Hence, the plasma will not flow to an un-emitting area to cause cross-talk effect. Further, the surface areas of the fluorescent material can be increased by coating the fluorescent material on the barrier ribs, thereby enhancing the light-emitting efficiency and uniformity of the cold cathode fluorescent flat lamp 200.

Figure 3A:
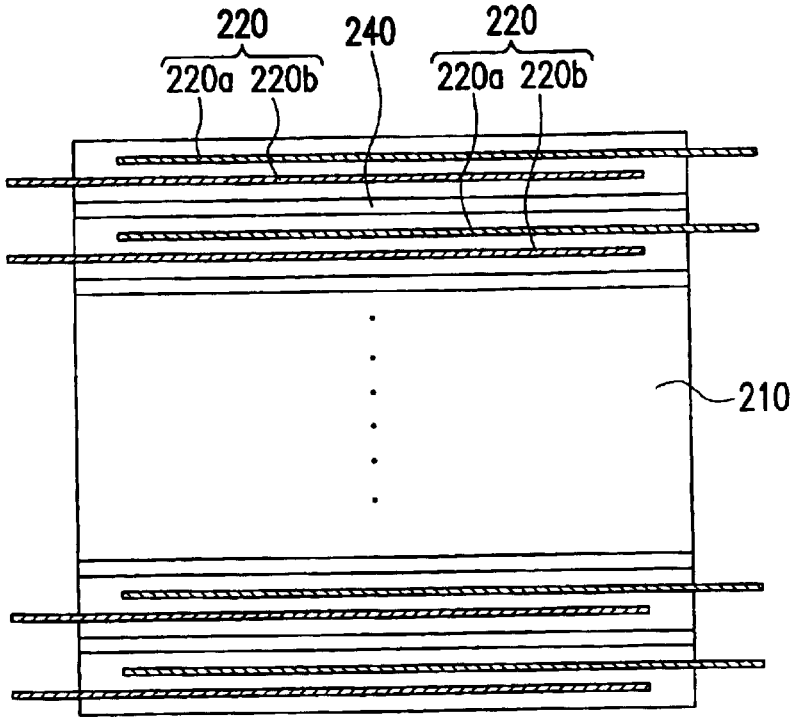
FIGS. 3A–3B show the arrangement of the electrode pairs in accordance with a preferred embodiment of the present invention.
Figure 3B:
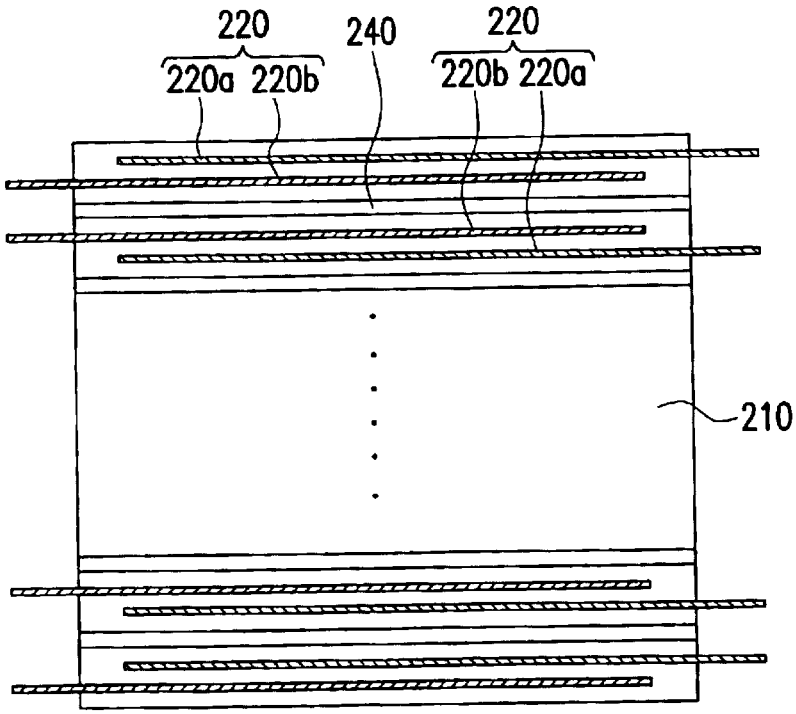

FIGS. 3A–3B show the arrangement of the electrode pairs in accordance with a preferred embodiment of the present invention. Referring to FIG. 3A, the electrode pairs 220 can be arranged in an order of X electrode 220*a*, Y electrode 220*b*, X electrode 220*a*, and Y electrode 220*b* on the first substrate 210. Such an arrangement allows different types electrodes to be disposed on the different sides of the barrier ribs 240. Referring to FIG. 3B, the electrode pairs 220 can be arranged in an order of X electrode 220*a*, Y electrode 220*b*, Y electrode 220*b* and X electrode 220*b*, on the first substrate 210. Such an arrangement allows same type of electrodes disposed on the different sides of the barrier ribs 240.

It should be noted that when the electrodes on the two sides of the barrier ribs 240 are of same type, as shown in FIG. 3B, it could prevent the barrier ribs 240 from breakdown. Hence, the electrodes on the two sides of the barrier ribs 240 can be arranged closer to the barrier ribs 240 to increase the discharge area.

Further, the same electrodes of the electrode pairs 220 can be connected in parallel to provide the same voltage waveform. For example, the X electrodes 220*a* of the electrode pairs 220 can be connected in parallel (not shown); and the Y electrodes 220*b* of the electrode pairs 220 can be connected in parallel. Further, the electrode (the X electrode 220*a* and the Y electrode 220*b*) of the electrode pairs 220 can be directed to the same side (not shown) so that the driving circuit need not be connected to two sides of the lamp.

Figure 4A:
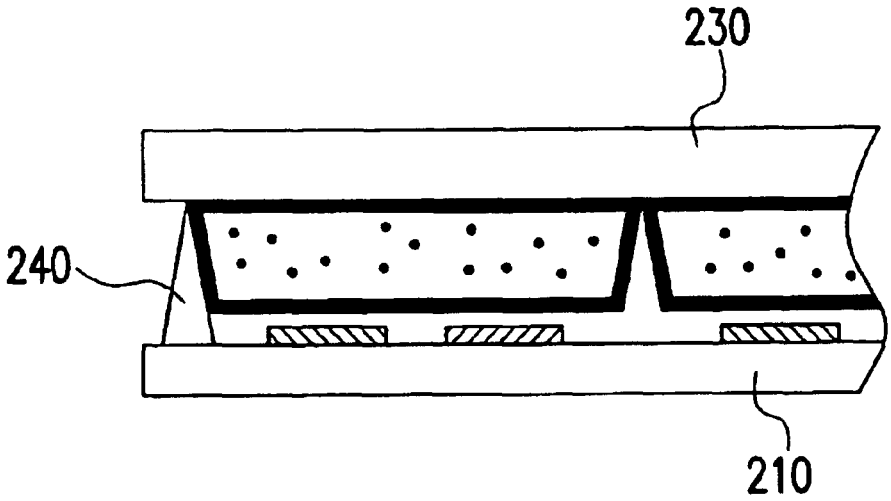
FIGS. 4A–4B show the shapes of barrier ribs in accordance with a preferred embodiment of the present invention.
Figure 4B:
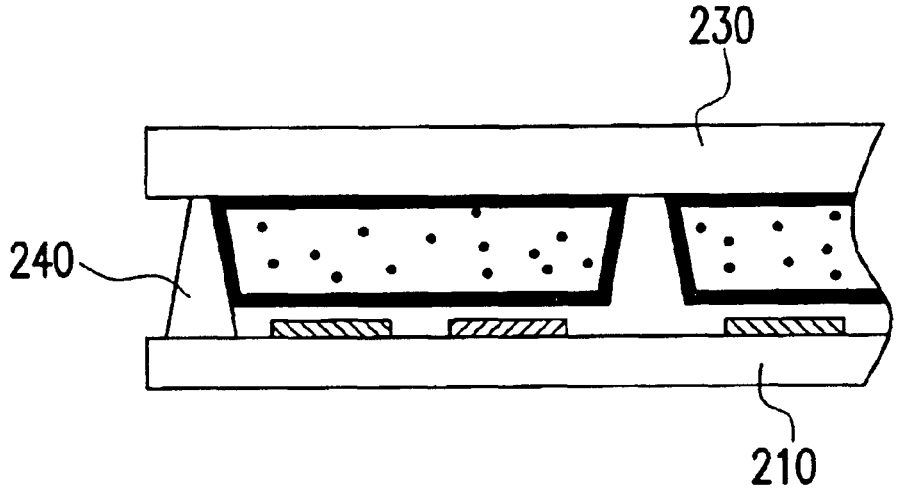

FIGS. 4A–4B show barrier ribs in accordance with a preferred embodiment of the present invention. The width of the bottom of the barrier ribs 240 is wider than the width of the top of the barrier ribs 240. The cross section of each of the plurality of barrier ribs is comprised of a triangle (as shown in FIG. 4A) or a trapezoid (as shown in FIG. 4B). This design can reduce blocking of the light output by the barrier ribs 240 and thereby a better light uniformity is achieved.

In brief, the present invention at least provides the following advantages:

By disposing a plurality of barrier ribs between two substrates to separate each electrode pair, the plasma will not flow to an un-emitting area during the on/off operation of the individual electrode pair to cause cross-talk effect. Thus, the light-emitting efficiency and the uniformity of the cold cathode fluorescent flat lamp can be effectively promoted.

The barrier ribs also provide support to reinforce the structure at the central part of the cold cathode fluorescent flat lamp 100. Hence, the barrier ribs can replace the conventional spacers.

The above description provides a full and complete description of the preferred embodiments of the present invention. Various modifications, alternate construction, and equivalent may be made by those skilled in the art without changing the scope or spirit of the invention. Accordingly, the above description and illustrations should not be construed as limiting the scope of the invention which is defined by the following claims.

What is claimed is:

1. A cold cathode fluorescent lamp, comprising:

a first substrate;

a plurality of electrode pairs, said plurality of electrode pairs being disposed on said first substrate, each of said plurality of electrode pairs includes an X electrode and Y electrode;

a second substrate disposed above said first substrate;

a plurality of barrier ribs disposed between said first substrate and said second substrate, said plurality of barrier ribs forming a plurality of independent gas discharge space between said first substrate and said second substrate, wherein each of said plurality of electrode pairs is disposed under one of said plurality of independent gas discharge space respectively;

a fluorescent material disposed on inner walls of said plurality of independent gas discharge space; and a discharge gas disposed in said plurality of independent gas discharge space.

2. The cold cathode fluorescent lamp of claim 1, wherein said plurality of barrier ribs are comprised of strips, and the width of the bottom of the barrier ribs is wider than that of the top of the barrier ribs.

3. The cold cathode fluorescent lamp of claim 2, wherein the cross section of said barrier ribs is a triangle.

4. The cold cathode fluorescent lamp of claim 2, wherein the cross section of said barrier ribs is a trapezoid.

5. The cold cathode fluorescent lamp of claim 1, wherein said plurality of barrier ribs are comprised of dielectric materials.

6. The cold cathode fluorescent lamp of claim 1, wherein said X electrodes of said plurality of electrode pairs are connected in parallel.

7. The cold cathode fluorescent lamp of claim 1, wherein said Y electrodes of said plurality of electrode pairs are connected in parallel.

8. The cold cathode fluorescent lamp of claim 1, wherein said plurality of electrode pairs are disposed in an order of said X electrode and said Y electrode alternately, on said first substrate.

9. The cold cathode fluorescent lamp of claim 1, wherein said plurality of electrode pairs is disposed in an order of said X electrode, said Y electrode , said Y electrode, and said X electrode, on said first substrate.

10. The cold cathode fluorescent lamp of claim 1, further comprising a dielectric layer disposed between said plurality of electrode pairs and a portion of said fluorescent material.

11. The cold cathode fluorescent lamp of claim 1, wherein said discharge gas is an inert gas.

12. The cold cathode fluorescent lamp of claim 1, wherein said inert gas includes at least one of Xe, Ne, Ar, and a mixture thereof.

13. The cold cathode fluorescent lamp of claim 1, wherein said plurality of electrode pairs is comprised of a metal.

14. The cold cathode fluorescent lamp of claim 13, wherein said metal includes at least one of Ag, Cu and Cr—Cu—Cr alloy.

* * * * *